US007777110B2

(12) United States Patent
Wallis

(10) Patent No.: US 7,777,110 B2
(45) Date of Patent: Aug. 17, 2010

(54) INSTRUMENT STAND

(75) Inventor: Timothy D. Wallis, East Peoria, IL (US)

(73) Assignee: Dingo Products, Inc, Decatur, IL (US)

( * ) Notice: Subject to any disclaimer, the term of this patent is extended or adjusted under 35 U.S.C. 154(b) by 0 days.

(21) Appl. No.: 12/436,676

(22) Filed: May 6, 2009

(65) Prior Publication Data

US 2009/0277320 A1 Nov. 12, 2009

Related U.S. Application Data

(60) Provisional application No. 61/126,782, filed on May 7, 2008.

(51) Int. Cl.
*G10D 3/00* (2006.01)

(52) U.S. Cl. ..... 84/327; 248/443

(58) Field of Classification Search ..... 84/327; 248/443

See application file for complete search history.

(56) References Cited

U.S. PATENT DOCUMENTS

| | | | | | |
|---|---|---|---|---|---|
| 1,368,452 | A | * | 2/1921 | Puff | 108/35 |
| 4,205,818 | A | | 6/1980 | Lawler | |
| 4,223,785 | A | | 9/1980 | Jacques | |
| D260,589 | S | | 9/1981 | O'Brien | |
| D265,873 | S | | 8/1982 | Smith | |
| 4,352,480 | A | | 10/1982 | Gathright | |
| 4,561,339 | A | | 12/1985 | Jensen | |
| 4,582,282 | A | | 4/1986 | Gracie | |
| 4,691,610 | A | * | 9/1987 | Gilbert | 84/327 |
| 4,742,751 | A | | 5/1988 | Cherry | |
| 4,887,536 | A | * | 12/1989 | Teichner | 108/35 |
| 4,943,021 | A | | 7/1990 | Cien et al. | |
| 4,966,062 | A | | 10/1990 | Driggers et al. | |
| 5,116,005 | A | | 5/1992 | LaGoy | |
| D329,342 | S | | 9/1992 | Schoenig | |
| 5,197,701 | A | | 3/1993 | Olson | |
| D337,345 | S | | 7/1993 | Gracie | |
| D342,401 | S | | 12/1993 | Kempton | |
| 5,313,866 | A | | 5/1994 | Smith | |
| 5,315,910 | A | | 5/1994 | Soupios | |
| 5,346,073 | A | | 9/1994 | Broersma et al. | |
| 5,350,143 | A | | 9/1994 | Hoshino | |
| 5,363,734 | A | | 11/1994 | Wilenken | |
| 5,383,634 | A | * | 1/1995 | Liao | 248/166 |
| D357,828 | S | | 5/1995 | Liao | |
| 5,497,689 | A | | 3/1996 | Hoshino | |
| 5,637,820 | A | | 6/1997 | Wittman | |
| 5,664,756 | A | * | 9/1997 | Liao | 248/443 |
| D389,341 | S | | 1/1998 | Danner et al. | |
| 5,713,547 | A | | 2/1998 | Yu | |
| 5,744,735 | A | * | 4/1998 | Liao | 84/327 |
| D396,579 | S | | 8/1998 | Kalayjian | |
| 5,833,051 | A | | 11/1998 | Tiefenbrun et al. | |

(Continued)

*Primary Examiner*—Jeffrey Donels
*Assistant Examiner*—Robert W Horn
(74) *Attorney, Agent, or Firm*—Barnes & Thornburg LLP

(57) ABSTRACT

A stand for a musical instrument having a body and a neck includes a main body and a pair front legs coupled to the main body. The pair of front legs is configured to receive a portion of the body of the musical instrument therein. A neck rest of the stand is removably coupled to the main body and is configured to receive a portion of the neck of the musical instrument therein.

16 Claims, 10 Drawing Sheets

U.S. PATENT DOCUMENTS 5,836,552 A * 11/1998 Yu ..... 248/166
D407,240 S 3/1999 Payne
D411,698 S 6/1999 Kalayjian
5,911,396 A 6/1999 Bireley
5,957,417 A * 9/1999 Yu ..... 248/166
5,973,244 A * 10/1999 McCulloch ..... 84/327
6,015,121 A 1/2000 Reid
6,036,159 A * 3/2000 Yu ..... 248/443
6,111,184 A 8/2000 Cloud et al.
6,113,040 A * 9/2000 Yu ..... 248/166
6,121,527 A 9/2000 Hamm
6,127,612 A 10/2000 Yu
6,145,639 A 11/2000 Roper
6,145,801 A 11/2000 Herring, Jr.
D435,365 S 12/2000 Eason et al.
D436,465 S * 1/2001 Berkman ..... D6/466
6,209,829 B1 4/2001 Yu
6,231,018 B1 5/2001 Barbieri
6,281,417 B1 8/2001 Ladao
6,283,421 B1 9/2001 Eason et al.
6,316,706 B1 11/2001 Sammons
6,323,405 B1 11/2001 Yu
6,323,406 B1 11/2001 Park
6,326,531 B1 12/2001 Bremner
6,388,180 B1 5/2002 Buttice-Cannon
6,412,742 B1 7/2002 Yu
6,439,532 B1 * 8/2002 Yu ..... 248/443
6,441,288 B1 8/2002 Lin
6,462,260 B2 10/2002 Fediakov
6,484,977 B1 11/2002 Yu
6,513,768 B1 2/2003 Hsieh
6,523,485 B1 * 2/2003 Cipolla ..... 108/14
6,533,228 B1 * 3/2003 Yu ..... 248/166
6,585,199 B1 7/2003 Yu
D478,738 S 8/2003 Workman
6,603,067 B1 8/2003 Woollen
6,622,981 B1 9/2003 Hsieh
D482,904 S * 12/2003 Slaymaker ..... D6/466
6,685,145 B2 2/2004 Mackay et al.
6,693,234 B2 2/2004 Smith
6,722,617 B2 * 4/2004 Wilfer ..... 248/163.1
6,723,909 B1 4/2004 Hooper, II
6,747,197 B2 6/2004 Kellogg
6,772,981 B1 8/2004 Yu
6,877,706 B2 4/2005 Harrison
6,881,884 B2 4/2005 Hsieh
6,891,099 B1 * 5/2005 Davis et al. ..... 84/421
6,951,280 B1 10/2005 Lee
D511,427 S * 11/2005 Meuniot et al. ..... D6/468
7,002,066 B2 2/2006 Yu
7,055,899 B2 * 6/2006 Zhurong et al. ..... 297/158.4
D539,554 S 4/2007 Palasini
D540,564 S 4/2007 Tai
7,258,320 B2 8/2007 Tai
D553,869 S * 10/2007 Nelson ..... D6/337
7,285,709 B2 10/2007 White et al.
7,291,778 B2 11/2007 Larry
7,300,027 B2 11/2007 Walker
D557,329 S * 12/2007 Lippert ..... D17/20
D562,030 S 2/2008 Parikh
7,342,162 B2 3/2008 Tai
D567,541 S 4/2008 Bermea
7,351,896 B2 4/2008 Clifford
7,375,269 B2 5/2008 Perkins
D571,124 S 6/2008 Strause
7,417,185 B2 8/2008 Ludwig
7,423,209 B2 9/2008 Chen
7,446,249 B2 11/2008 Driscoll
7,514,616 B2 * 4/2009 Sawhney ..... 84/327
D595,077 S 6/2009 Tai
7,547,835 B1 6/2009 Mayor
D596,875 S * 7/2009 Small et al. ..... D6/466
7,560,630 B1 7/2009 Keenan, Jr.
7,649,131 B1 * 1/2010 Yu ..... 84/387 A
2002/0056793 A1 5/2002 Bell
2002/0070319 A1 6/2002 Yu
2002/0088914 A1 7/2002 Yu
2002/0092407 A1 7/2002 Lin
2002/0104426 A1 8/2002 Fediakov
2003/0121395 A1 7/2003 Smith
2003/0173473 A1 9/2003 Mackay et al.
2003/0173484 A1 9/2003 Hsieh
2003/0196542 A1 10/2003 Harrison, Jr.
2003/0221538 A1 12/2003 Stevens
2004/0016856 A1 1/2004 Wilfer
2004/0031373 A1 2/2004 Kellogg
2004/0056166 A1 3/2004 Harrison
2004/0182984 A1 9/2004 Sandkuhl
2004/0237753 A1 12/2004 Savage
2004/0237755 A1 12/2004 Laio
2005/0000348 A1 1/2005 Workman
2005/0011337 A1 1/2005 Hsieh
2005/0016354 A1 1/2005 Kent
2005/0035255 A1 2/2005 Walker
2005/0121567 A1 * 6/2005 Meuniot ..... 248/150
2005/0145095 A1 7/2005 Larry
2005/0155481 A1 7/2005 Yu
2006/0016952 A1 1/2006 Workman
2006/0032359 A1 2/2006 Smith
2006/0156896 A1 7/2006 Perkins
2007/0000375 A1 1/2007 Harrison, Jr.
2007/0125222 A1 6/2007 Clifford
2008/0006139 A1 1/2008 Tai
2008/0028913 A1 2/2008 Driscoll
2008/0047637 A1 2/2008 Mosier
2008/0060498 A1 3/2008 Samu
2008/0061195 A1 3/2008 Carnevali
2008/0168883 A1 7/2008 Chen
2008/0216633 A1 9/2008 Winch
2009/0056522 A1 3/2009 Mercer
2009/0277320 A1 * 11/2009 Wallis ..... 84/327

* cited by examiner

INSTRUMENT STAND

This application claims priority to U.S. Provisional Patent Application Ser. No. 61/126,782, filed May 7, 2008 titled INSTRUMENT STAND, the entirety of which is hereby incorporated by reference.

TECHNICAL FIELD

The present disclosure relates generally to a musical instrument stand for supporting and displaying a musical instrument thereon.

BACKGROUND

Stands are oftentimes used to support and display a musical instrument, such as a guitar, for example, thereon. Typically, guitar stands, for example, rest on the floor and support the guitar from the base or body of the guitar. In this configuration, the guitar is generally supported in an upright position. Other stands or props may be used to support the neck of the guitar to allow a user to more easily work on the guitar, for example. In this configuration, the guitar is generally supported in a horizontal position. Some guitar stands are relatively small and light and may be folded when not in use.

SUMMARY

The present invention may comprise one or more of the features recited in the attached claims, and/or one or more of the following features and combinations thereof. According to one aspect of the present disclosure, a stand for a musical instrument having a body and a neck includes a main body having a first body portion, a second body portion, and a hinge coupled to and positioned between the first and second body portions. Illustratively, the first and second body portions are configured to pivot relative to one another. The stand further includes a pair of front legs having a first front leg coupled to the first body portion and a second front leg coupled to the second body portion. The pair of front legs is configured to receive the body of the musical instrument thereon. A neck rest of the stand is configured to be removably coupled to the main body and is configured to receive the neck of the musical instrument thereon.

In one embodiment, the first front leg may be pivotably coupled to the first body portion and may be movable relative to the first body portion between a stowed position and an extended position. Further, the second front leg may be pivotably coupled to the second body portion and may be movable relative to the second body portion between a stowed position and an extended position. Further illustratively, each of the first and second front legs may include a hook and each of the first and second body portions may include a respective first and second pin received within the hook of each of the respective first and second front legs when the front legs are each in the extended position. Each of the first and second front legs may be positioned within the outer perimeter of the respective body portion when in the stowed position.

In other illustrative embodiments, one of the first and second body portions may include a pair of apertures and the neck rest may include a pair of pegs configured to be received within the pair of apertures when the neck rest is in a stowed position. Further illustratively, the first and second body portions may each include a front end wall having respective first and second bores formed therein. The first and second bores may be configured to receive the pair of pegs of the neck rest therein when the neck rest is in a use position.

In still other illustrative embodiments, the stand may further include a pair of rear legs having a first rear leg pivotably coupled to the first body portion and a second rear leg pivotably coupled to the second body portion. Illustratively, the first and second rear legs may each be movable between a stowed position generally located within the outer perimeter of the respective body portion and an extended position.

In yet other illustrative embodiments, the neck rest may include a curved member configured to support a neck of a musical instrument thereon and two tabs attached thereto. Illustratively, the neck rest may further include a first peg coupled to one of the tabs of the neck rest and a second peg coupled to the other one of the tabs of the neck rest. Further, the neck rest may be configured to be positioned in a stowed position wherein the pegs are received within first and second apertures each formed in one of the first and second body portions of the main body. The neck rest may further be configured to be positioned in a use position wherein the first peg is received within a first bore formed in a front end wall of the first body portion and the second peg is received within a second bore formed in the front end wall of the second body portion.

In still other illustrative embodiments, the hinge of the main body may include a first plurality of tabs coupled to the first body portion and a second plurality of tabs coupled to the second body portion. The first and second plurality of tabs may be alternatingly positioned between each other such that each tab of the second plurality of tabs is positioned between adjacent tabs of the first plurality of tabs. Illustratively, the hinge may further include a stop mechanism to prevent pivoting movement of the first and second body portions relative to each other beyond a predetermined orientation.

According to another aspect of the present disclosure, a stand for a musical instrument having a body and a neck includes a main body configured to move between a use position and a stowed position. The stand further includes a front leg pivotably coupled to the main body and configured to move between a stowed position wherein generally the entire front leg is positioned within the outer perimeter of the main body and an extended position wherein the front leg extends out beyond the outer perimeter of the main body. The front leg is configured to support the body of the musical instrument when the front leg is in the use position. The stand further includes a rear leg pivotably coupled to the main body and configured to move between a stowed position wherein generally the entire rear leg is positioned within the outer perimeter of the main body and an extended position wherein the rear leg extends outwardly beyond the outer perimeter of the main body.

In one illustrative embodiment, the main body may include a first body portion and a second body portion pivotably coupled to the first body portion. Illustratively, the main body may further include a hinge having a first plurality of tabs integrally formed with the first body portion and a second plurality of tabs integrally formed with the second body portion.

In another illustrative embodiment, the stand further includes a neck rest configured to be removably coupled to the main body. Illustratively, the neck rest may be movable between a stowed position and a use position. Further, the neck rest may be coupled to main body in the stowed position and may be positioned such that generally the entire neck rest is located within the outer perimeter of the main body. The neck rest may further be is coupled to the main body in the use position to be positioned outside the outer perimeter of the main body.

In still another illustrative embodiment, the stand may be able to be positioned in a first configuration such that the stand is configured to receive and support the body of the musical instrument thereon and a second configuration such that the stand is configured to receive and support a portion of the neck of the musical instrument thereon.

According to yet another aspect of the present disclosure, a stand for a musical instrument having a body and a neck includes a main body configured to move between an opened position and a closed position. The main body includes a first body portion, a second body portion, and a hinge pivotably coupling the first and second body portions to each other. The stand further includes a pair of front legs pivotably coupled to the main body. Illustratively, each leg of the pair of front legs is generally J-shaped to define a J-shaped cut-out configured to receive the body of the musical instrument therein. The stand further includes a pair of rear legs pivotably coupled to the main body, and a neck rest configured to be removably coupled to the main body. The neck rest includes curved portion configured to support the neck of the musical instrument thereon. Illustratively, the first and second body portions are spaced apart from each other in the closed position in order to define a storage space between the first and second body portions configured to receive the pair of front legs, the pair of rear legs, and the neck rest therein.

BRIEF DESCRIPTION OF THE DRAWINGS

The detailed description particularly refers to the accompanying figures in which.

DETAILED DESCRIPTION OF THE DRAWINGS

Figure 1:
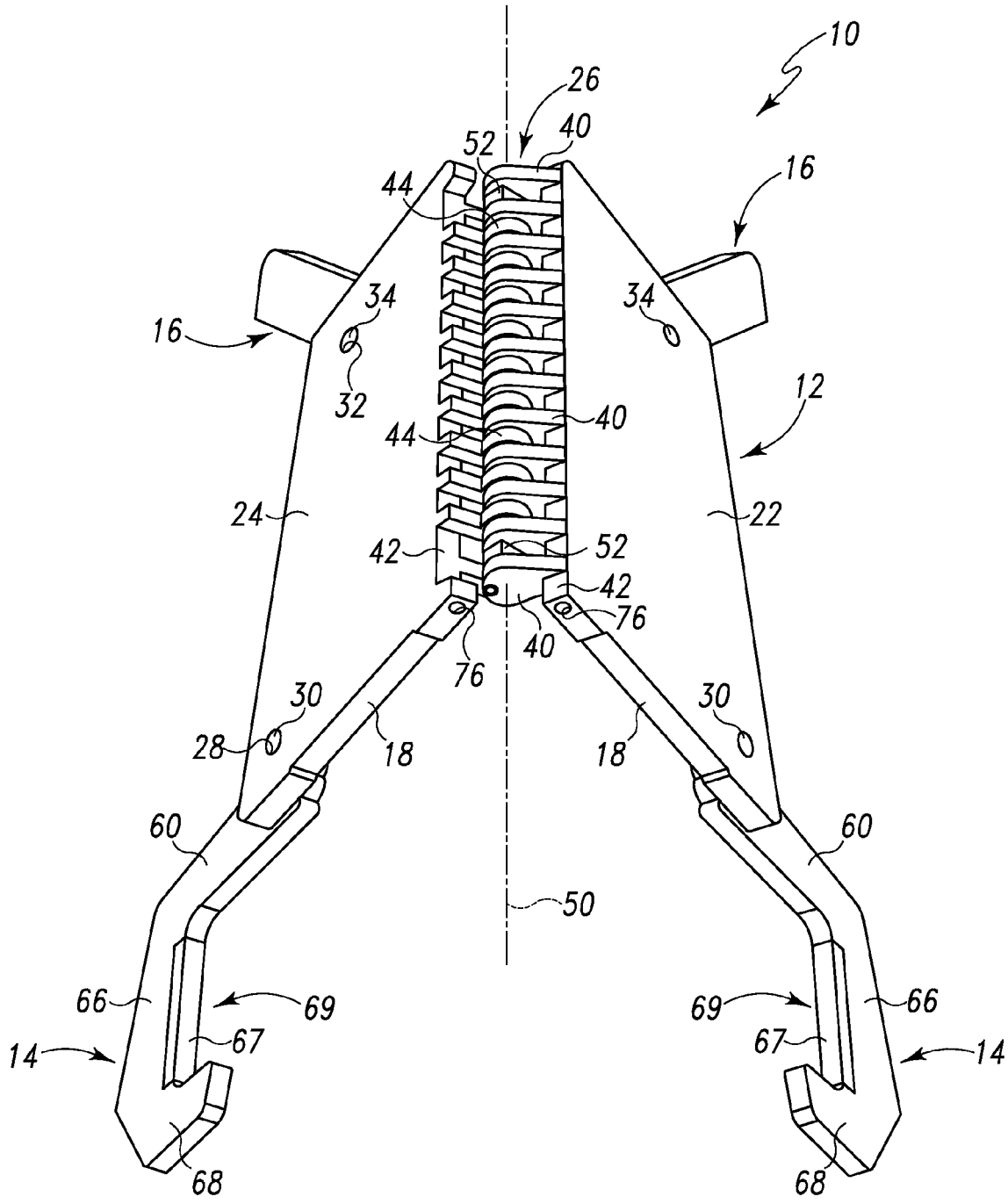
FIG. 1 is a front perspective view of a stand in a first use position for supporting an instrument thereon.

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

An instrument stand 10 is provided to support a guitar, such as guitar 70 (shown in phantom in FIGS. 2 and 4), or other musical instruments in one or more positions. For example, the stand 10 is movable between a closed, storage position shown in FIG. 8, a first use position shown in FIGS. 1 and 2, and a second, open or use position shown in FIGS. 3 and 4. As is discussed in greater detail below, the first use position of the stand 10 is configured to support the guitar 70 in an upright position (as shown in FIG. 2) whereas the second use position is configured to support the guitar 70 in a horizontal position (as shown in FIG. 4).

Illustratively, the stand 10 includes a main body 12, a pair of front legs 14 coupled to the body 12, and a pair of rear legs 16 coupled to the main body 12. As is discussed in greater detail below, the stand 10 further includes a neck rest 20 (shown in FIGS. 3, 4, and 5) configured to be coupled to the main body 12 as well. Illustratively, the main body 12, front legs 14, rear legs 16, and neck rest 20 are each made from a plastic. However, it is within the scope of this disclosure for each of the body 12, front and rear legs 14, 16, and neck rest 20 to be made from other suitable materials such as metal and wood, for example.

Looking now to FIGS. 1, 3, and 5-7, for example, the main body 12 includes first and second body portions 22, 24 coupled together at a top side of each body portion 22, 24 by a hinge 26. As shown in FIGS. 1, 3, and 5-7, each body portion 22, 24 has four sides and is shaped as a quadrangle. However, it is within the scope of this disclosure to include body portions having other suitable shapes as well.

Figure 2:
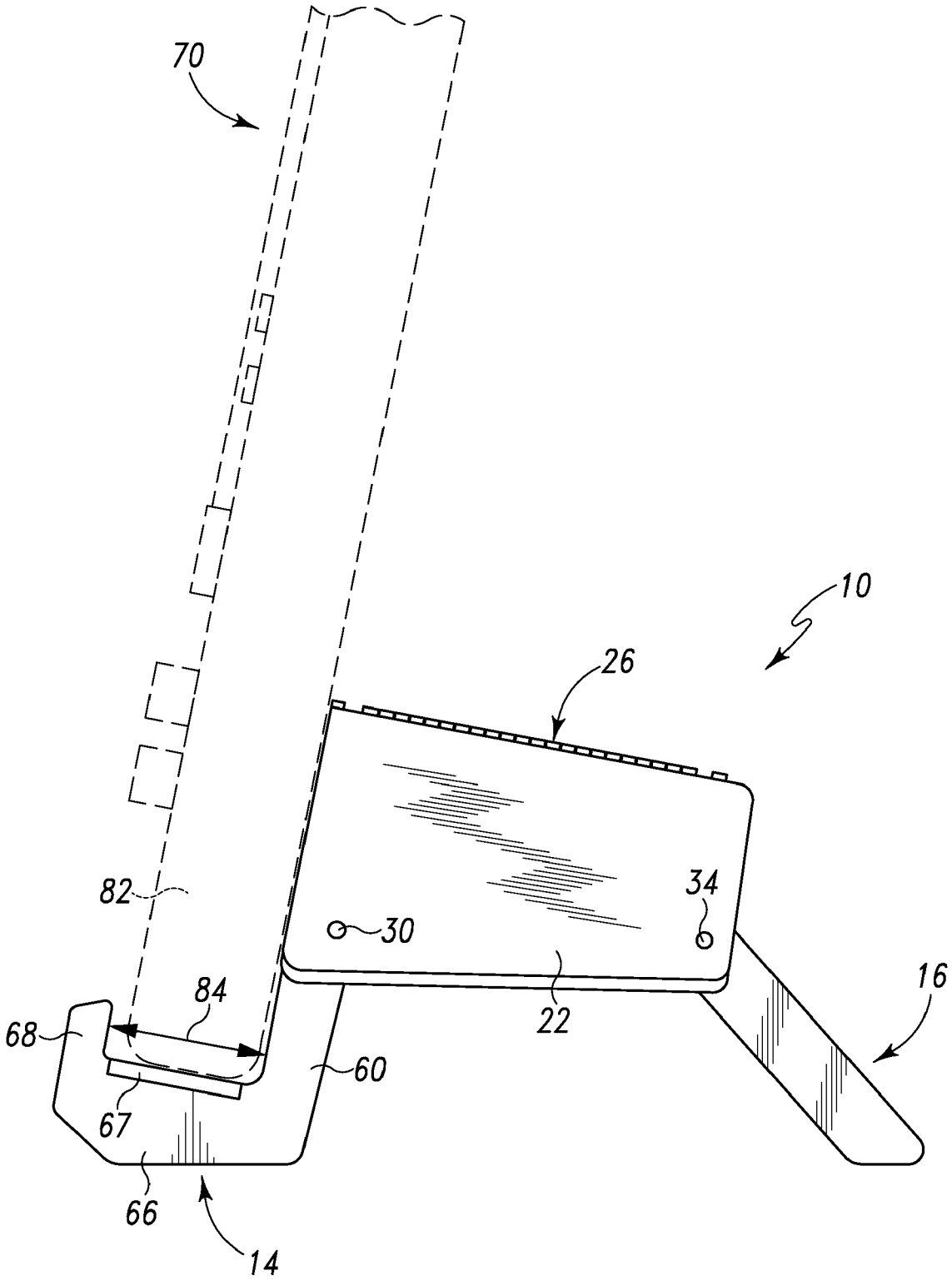
FIG. 2 is a side view of a portion of a guitar (shown in phantom) supported by the stand.

As shown in FIG. 1, a front, lower corner section of each body portion 22, 24 includes an aperture 28 for receiving a fastener 30, such as a rivet or screw, therethrough in order to pivotably couple one of the front legs 14 thereto. Each body portion 22, 24 further includes another aperture 32 located at a rear, lower corner section of each body portion 22, 24 for receiving a fastener 34, such as a rivet or screw, therethrough in order to pivotably couple one of the rear legs 16 thereto. Finally, as is discussed in greater detail below, the second body portion 24 includes two neck rest apertures 36 configured to receive respective pegs (not shown) of the neck rest 20 therein in order to locate the neck rest 20 in a storage position when not in use.

Illustratively, the hinge 26 of the main body 12 includes a first plurality of tabs 40 coupled to the first body portion 22. The tabs 40 are coupled to an upper edge 42 of the first body portion 22 and extend outwardly therefrom. The tabs 40 are spaced-apart from each other and a post 41 (shown in FIG. 8) is coupled to and extends between each of the adjacent tabs 40. The hinge 26 further includes a second plurality of generally C-shaped tabs 44 coupled to the second body portion 24. The tabs 44 are coupled to an upper edge 42 of the second body portion 24 and extend outwardly therefrom. The tabs 44 are spaced-apart from each other in order to interlock with the tabs 40 and to receive a post 41 therein. Illustratively, the posts 41 define a pivot axis 50 of the hinge 26 such that the first and second body portions 22, 24 are configured to pivot about the axis 50 between the opened (or use) and closed positions of the stand 10.

The hinge 26 further includes a stop mechanism configured to prevent pivoting movement of the first and second body portions beyond a predetermined orientation. Illustratively, the stop mechanism includes stop tabs 52 coupled to the second body portion 24 and positioned at first and second axial ends of the hinge 26 as well as stop posts 54 (shown in FIG. 8) coupled to and positioned between the first two and last two tabs 40 of the hinge 26. The stop posts 54 are not in axial alignment with the posts 41 defining the pivot axis 50, but are offset therefrom. Each stop post 54 is configured to be received by one of the first and second stop tabs 52 of the hinge 26 such that as the body portions 22, 24 are pivoted away from each other toward the opened position of the main body 12, the stop posts 54 engage the stop tabs 52 in order to prevent the body portions 22, 24 from pivoting further outwardly from each other about the axis 50. As such, the stop tabs 52 and the stop posts 54 cooperate with each other to prevent the bottom ends of the body portions 22, 24 from moving away from each other beyond a certain predetermined distance, i.e., the fully opened or use position of the main body 12, shown in FIGS. 1 and 2, for example.

Illustratively, the tabs 40, posts 41, and stop posts 54 of the hinge 26 are formed integrally with the first body portion 22 to define a single, unitary structure. However, it is within the scope of this disclosure for such components of the hinge 26 to be formed separately from the first body portion 22 and subsequently coupled thereto. Similarly, the tabs 44 and stop tabs 52 of the hinge 26 are formed integrally with the second body portion 24 to define a single, unitary structure. However, it is within the scope of this disclosure for such components of the hinge 26 to be formed separately from the second body portion 24 and subsequently coupled thereto. While the particular illustrative hinge 26 is shown and described herein, other types of hinges may be used as well in order to allow the first and second body portions 22, 24 to pivot relative to each other.

Looking now to FIGS. 1, 2 and 5-7, each front leg 14 is generally "J-shaped" and includes a rear member 60 having an aperture 62 therethrough. Illustratively, the aperture 62 of each leg 14 is configured to align with the respective aperture 28 of one of the body portions 22, 24 in order to receive the fastener 30 therethrough to pivotably couple the leg 14 to the main body 12. As is discussed in greater detail below, the rear member 60 further includes a hook 64 configured to cooperate with a portion of the main body 12 to prevent pivotal movement of the front leg 14 beyond a predetermined position when the front leg 14 is pivoted to an extended, or use, position.

Each front leg 14 further includes a base member 66 and a front member 68 generally parallel to the rear member 60 to define a J-shaped cut-out 69. Illustratively, the base member 66 of each front leg 14 includes a pad 67 configured to support the body 82 of the guitar 70 thereon. The illustrative pad 67 is made from a softer material than the surrounding portions of the base member 66 in order to provide a cushioned and generally non-slip surface upon which the body 82 of the guitar 70 may rest. In particular, the pad 67 is made from a rubber material. However, it is within the scope of this disclosure to provide a pad 67 made from any suitable material to cushion and support the body of a guitar thereon. In particular, the pad 67 may be made from a material that is not harmful to and does not promote the degradation of a nitrocellulose finish on a guitar, for example. Further, it is within the scope of this disclosure to provide a stand having legs without any additional pad thereon as well.

Each leg 14 is configured to receive the body 82, or a portion of the body 82, of the guitar 70 within the J-shaped cut-out 69 between the front and rear members 68, 60, as shown in FIG. 2. Illustratively, the front legs 14 are sized and shaped to provide the J-shaped cut-out 69 having a distance 84 of approximately 2 inches between the front and rear members 68, 60 of each leg 14 in order to accommodate guitar bodies up to approximately 1.75 inches thick. However, as is discussed in greater detail below, the front legs 14 may be sized and shaped to provide a J-shaped cut-out defining a distance between the front and rear members 68, 60 able to accommodate and support musical instruments of different sizes therein.

Figure 5:
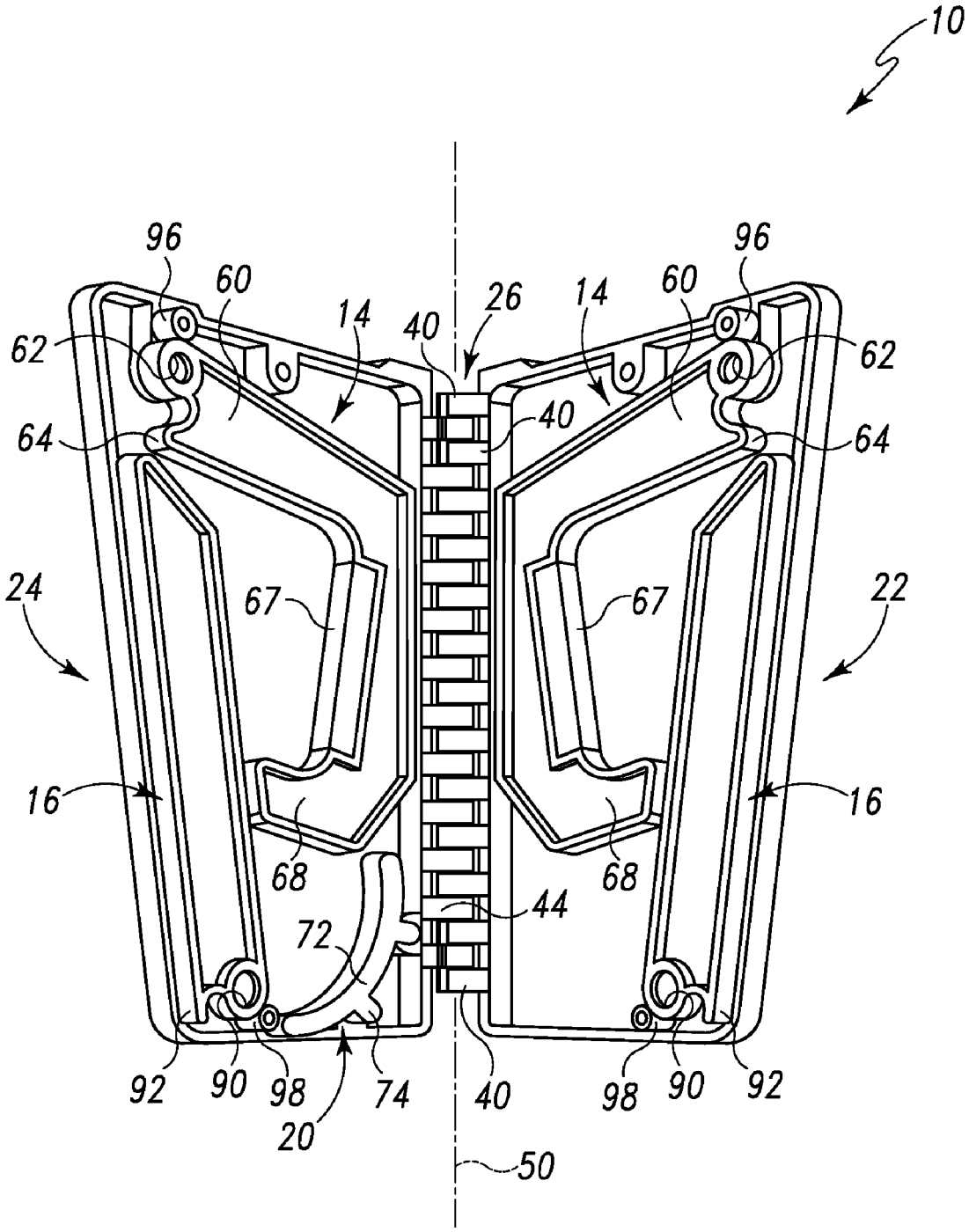
FIG. 5 is a bottom perspective view of the stand showing a main body of the stand in an opened position and the front and rear legs of the stand in a stowed position.
Figure 6:
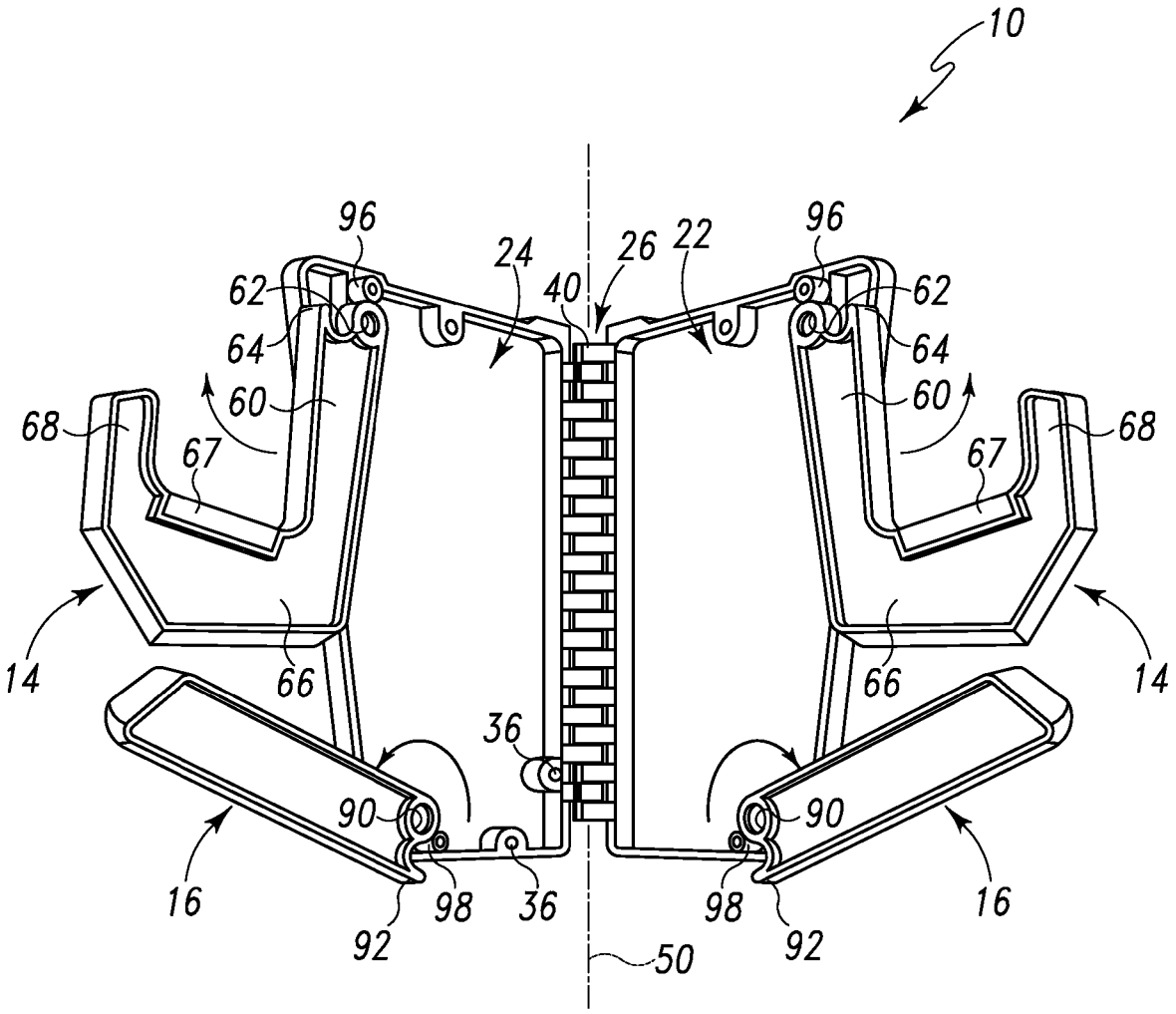
FIG. 6 is a bottom perspective view of the main body of the stand in the opened position showing the front and rear legs of the stand moving toward an extended position.
Figure 7:
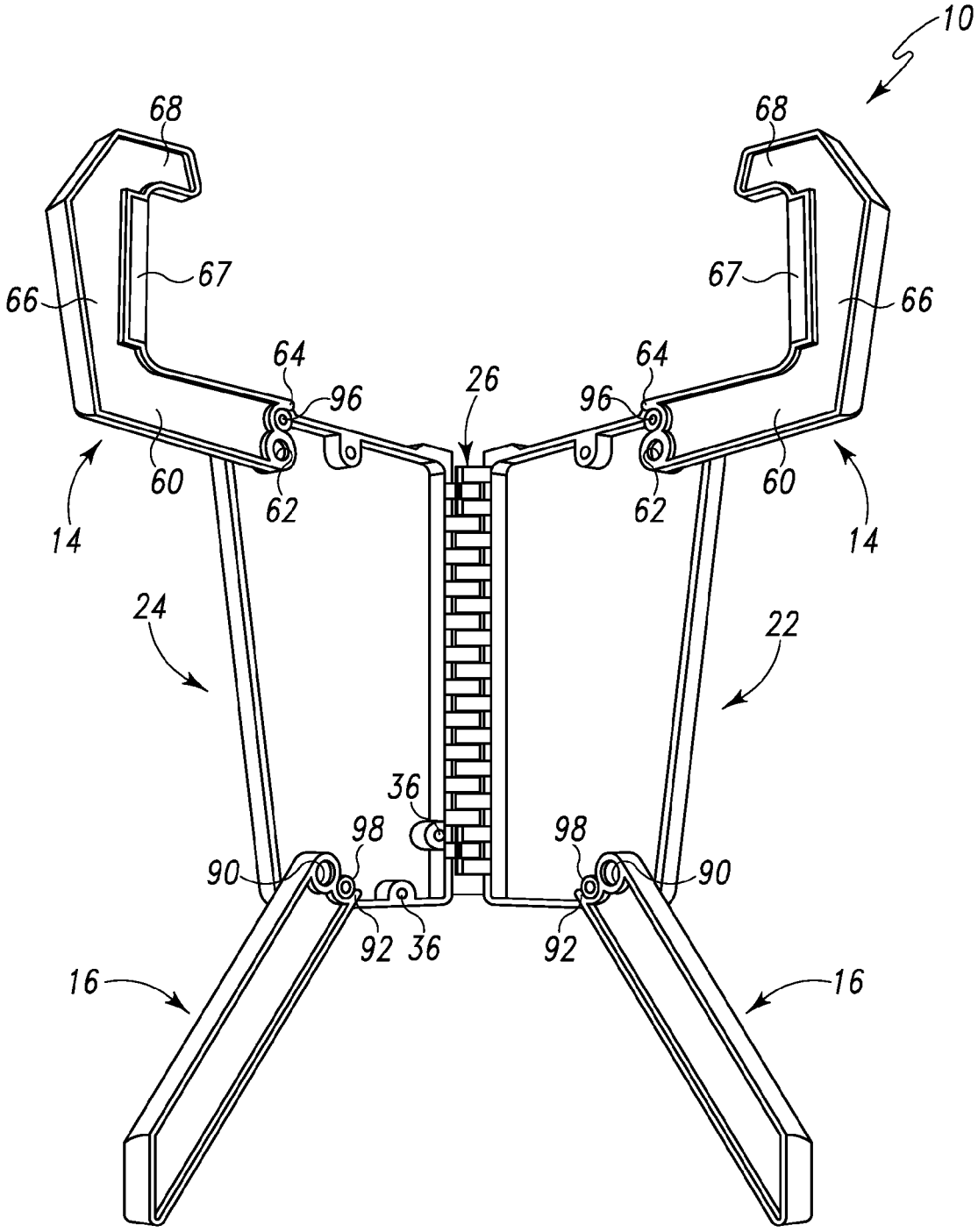
FIG. 7 is a bottom perspective view of the stand in the first use position showing the front and rear legs of the stand in the extended position.

Looking now to FIGS. 5-7, each rear leg 16 of the stand 10 includes an aperture 90 configured to align with the respective aperture 32 of the body portion 22, 24 in order to receive the fastener 34 therethrough to pivotably couple the rear leg 16 to the main body 12. Each rear leg 16 further includes a hook 92 configured to prevent pivotal movement of the rear leg 16 relative to the main body 12 beyond a predetermined position. It is understood that while the stand 10 includes the rear legs 16 pivotably coupled to the body portions 22, 24, it is within the scope of this disclosure to include a stand having rear legs or one or more rear supports which are not pivotably coupled to the respective body portions 22, 24. It is further within the scope of this disclosure to include a stand without rear legs.

Figure 3:
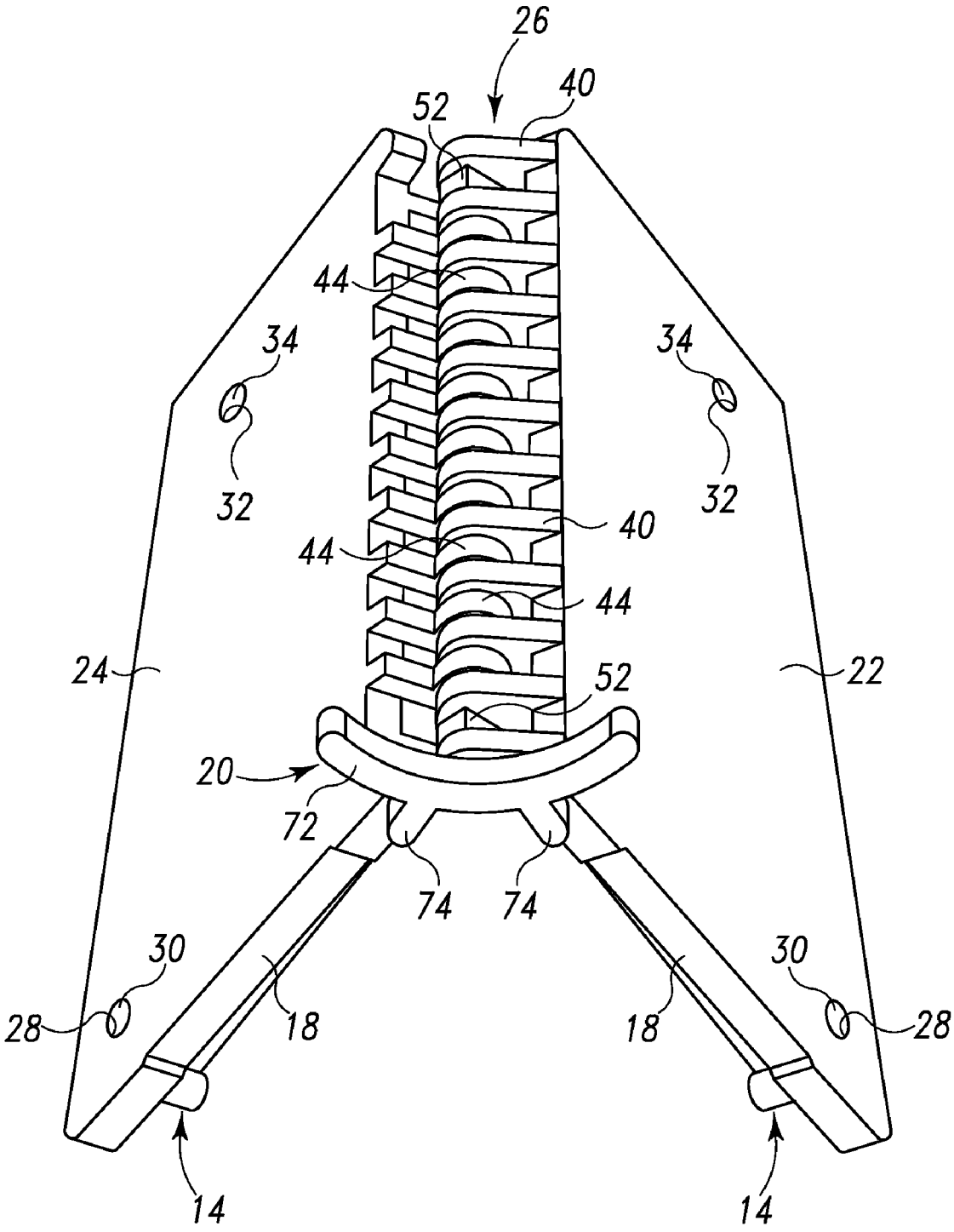
FIG. 3 is a front perspective view of an alternative arrangement of the stand in a second use position showing a neck rest of the stand provided to support the neck of the guitar.
Figure 4:
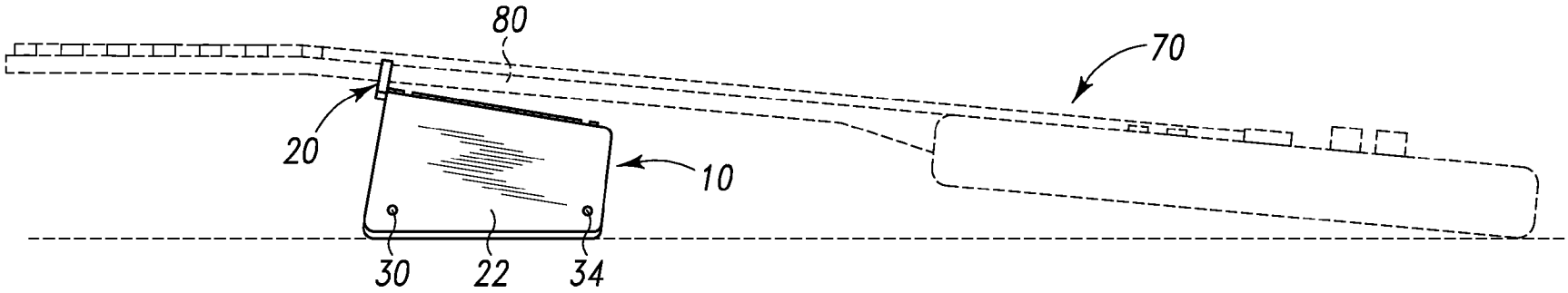
FIG. 4 is a side view of the stand in the second use position showing the neck rest supporting the neck of the guitar thereon.
Figure 8:
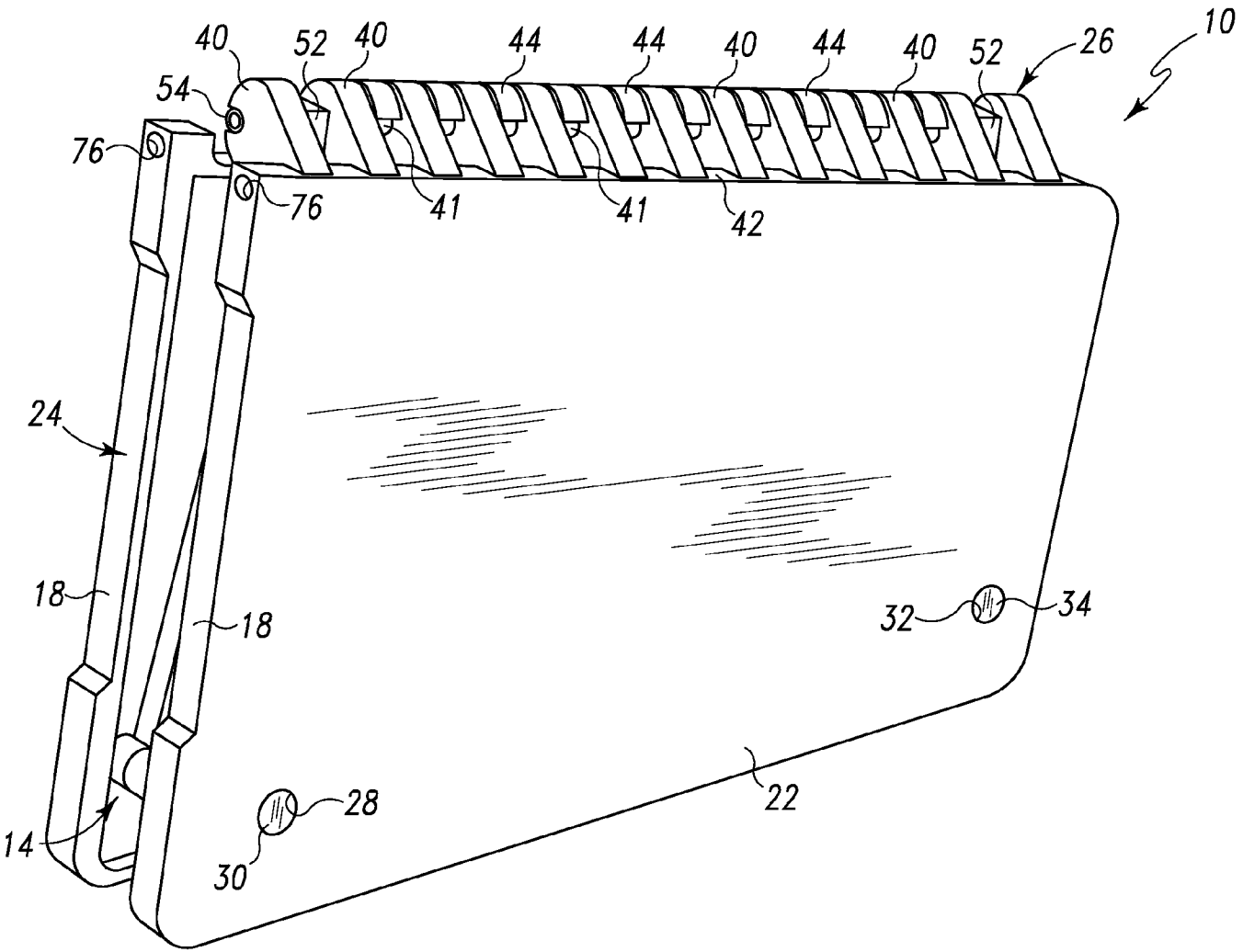
FIG. 8 is a perspective view of the stand in a closed position.

As discussed briefly above, the stand 10 is movable between a stowed position or configuration, shown in FIG. 8, the first use position or configuration, shown in FIGS. 1, 2, and 7, and the second use position or configuration shown in FIGS. 3 and 4. In the stowed position, the front legs 14 and rear legs 14 are each moved to their respective stowed positions such that each is positioned within the outer perimeter of the body portion 22, 24 to which each is coupled, as shown in FIG. 5, for example. As further shown in FIG. 5, the neck rest 20 is in a stowed configuration coupled to the second body portion 24 and is positioned within the outer perimeter of second body portion 24 as well.

As such, in the stowed position, the first and second body portions 22, 24 are spaced apart from each other in order to define a storage space therebetween. Each of the front legs 14, the rear legs 16, and the neck rest 20 are configured to be positioned generally entirely within this storage space when the stand 10 is in the stowed position. Further, in this stowed position, pegs (not shown) of the neck rest 20 are received within apertures 36 (shown in FIGS. 6 and 7) of the second body portion 24 to secure the neck rest 20 to the main body 12 of the stand 10. Illustratively, while the neck rest 20 is configured to be coupled to the second body portion 24 in the stowed configuration, it is within the scope of this disclosure to couple the neck rest 20 to the first body portion in the stowed configuration as well.

To move the stand 10 to the first use position, a user simply pivots the first and second body portions 22, 24 away from each other about the pivot axis 50, as shown in FIG. 5. The front and rear legs 14, 16 are then pivoted relative to the main body 12 to their respective use positions, as shown in FIGS. 6-7. Illustratively, first the rear legs 16 are pivoted relative to the main body 12 about the fastener 34 (as shown in FIG. 6) in order to allow the front legs 14 to be pivoted relative to the main body 12 about the fastener 30 thereafter. Illustratively, when moving the front and rear legs 14, 16 from the extended position to the stowed position, first the front legs 14 are pivoted relative to the main body 12 to a position contained within the outer perimeter of each respective body portion 22, 24 and then the rear legs 16 are pivoted relative to the main body 12 to be contained within the outer perimeter of the respective body portion 22, 24 as well.

As discussed above, each front leg 14 is pivoted to an extended position such that a front locking pin 96 (shown in FIGS. 5-7) coupled to the inner surface of each body portion 22, 24 is received within the hook 64 of each respective front leg 14. Accordingly, the front legs 14 are prevented from further pivoting motion relative to the main body 12 and are maintained in the extended position such that a portion of each leg 14 is located outside the outer perimeter of the respective body portion 22 to which it is attached. Similarly, each rear leg 16 is pivoted to a position such that a rear locking pin 98 (shown in FIGS. 5-7) coupled to the inner surface each body portion 22 is received within the hook 92 of each respective rear leg 16. Accordingly, the rear legs 16 are prevented from further pivoting motion relative to the main body 12 and are maintained in the extended position.

Once the stand 10 is in the first use position such that the main body 12 is in an opened position and the front and rear legs 14, 16 are in extended positions, the body 82 of a guitar, such as guitar 70, may be placed within the J-shaped cutout 69 of the front legs 14 such that the back of the guitar body 82 rests on and is further supported by a front surface or end wall 18 of each body portion 22, 24, as shown in FIG. 2. As such, the guitar 70 is supported in an upright position for display or simply when not in use. As noted above, the stop tabs 52 and stop posts 54 of the hinge 26 cooperate with each other to prevent the bottom end of each body portion 22, 24 of the stand 10 from moving farther away from each other beyond a predetermined distance as the stand 10 supports the weight of the guitar 70 thereon.

Illustratively, the body 82 of the guitar 70 is supported in the upright position by the front legs 14 and the front end wall 18 of the body portions 22, 24. However, it is within the scope of this disclosure to include an extension (not shown), such as a telescoping extension, which is extendable upwardly to engage and support the neck 80 of the guitar 70 as well. Such an extension may be removably coupled to the main body 12 of the stand 10, for example.

Looking now to FIGS. 3 and 4, the stand 10 of the present disclosure includes the neck rest 20, as noted above, and may be positioned or configured in the second use position. In the second use position, the stand 10 operates to support the neck 80 of the guitar 70 when the guitar 70 is in a generally horizontal position, as shown in FIG. 4. As such, the stand 10 operates to support both the guitar 70 in an upright position for display, but also to support the neck 80 of the guitar 70 when a user wants to work on his/her guitar 70. As shown in FIGS. 3 and 4, the neck rest 20 includes a curved member 72 having two tabs or ears 74 attached thereto. Each ear 74 includes a peg (not shown) coupled thereto.

When the stand 10 is in the stowed position (as shown in FIG. 8), each peg of the neck rest 20 is configured to be received within one of the two neck rest apertures 36 formed in the second body portion 24 such that the neck rest 20 is stowed within the main body 12 of the stand 10. Further, the neck rest 20 may remain in this stowed position when the stand 10 is in the first use configuration to support the guitar 70 in an upright position, such as that shown in FIGS. 1 and 2.

When the stand 10 is to be configured in the second use position to support the neck 80 of the guitar 70, the neck rest 20 is removed from its stowed position and the main body 12 of the stand 10 is moved to the open, or use, position. The pegs of the neck rest 20 are inserted into bores 76 (shown in FIG. 1) formed in the front end wall 18 of each body portion 22, 24. Illustratively, as shown in FIGS. 3 and 4, the front and rear legs 14, 16 of the stand 10 remain in their stowed positions when the stand 10 is configured in the second use position. Illustratively, however, it is within the scope of this disclosure to move the front and/or rear legs 14, 16 to their extended positions when configuring the stand 10 in the second use position.

As noted above, a user may rest the neck 80 of his/her guitar 70 on the curved member 72 of the neck rest 20 in order to allow the user to work on the guitar 70, for example, as shown in FIG. 4. Accordingly, the stand 10 is configured to operate as both a stand which supports the guitar 70 in an upright, on-display position, as shown in FIGS. 1 and 2, as well as a stand which supports the guitar 70 in a generally horizontal position, as shown in FIGS. 3 and 4.

Figure 9:
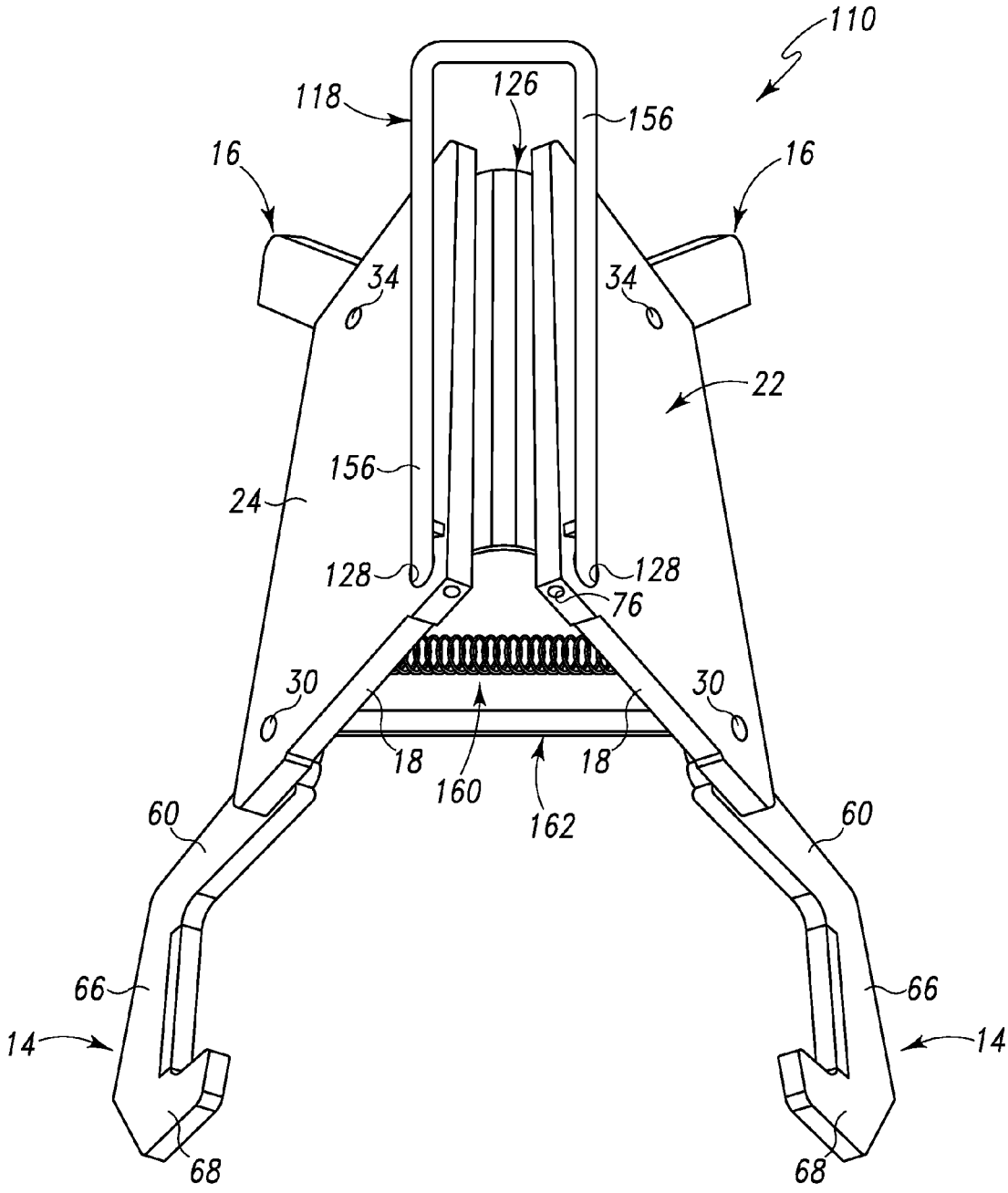
FIG. 9 is a front perspective view of another instrument stand.
Figure 10:
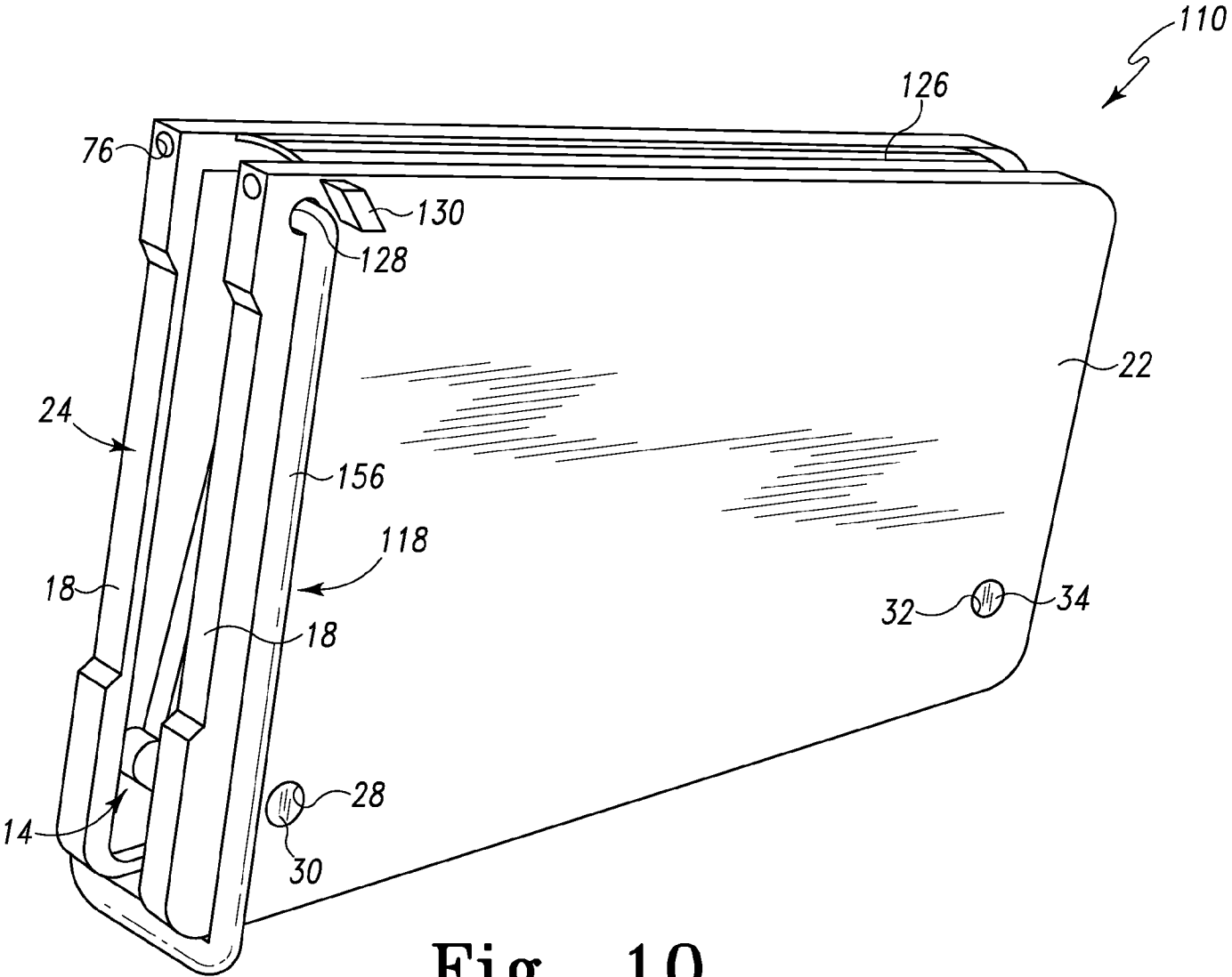
FIG. 10 is a side view of the instrument stand of FIG. 9 in the closed position.

Looking now to FIGS. 9 and 10, another instrument stand 110 is provided. Illustratively, the stand 110 is similar to the stand 10. As such, like reference numerals are used to denote like components. Illustratively, the first and second body portions 22, 24 of the main body 12 are coupled together by a living hinge 126. Similar to the stand 10, the living hinge 126 and the first and second portions 22, 24 of the main body 12 of the stand 110 are molded or otherwise formed as a unitary structure. However, each body portion 22, 24 of the main body 12 may be molded or formed separately and coupled together using a separate hinge, such as the living hinge 126 or the hinge 26 coupled to each of the body portions 22, 24.

The stand 10 further includes a brace 118 pivotably coupled to the main body 12. The brace 18 of the stand 10 is generally rectangular in shape and includes open, or unconnected, ends (not shown). Illustratively, an upper front corner section of each body portion 22, 24 includes an aperture 128 for receiving the first and second ends of the brace 118 therein in order to pivotably couple the brace 118 thereto. Alternatively, a fastener, such as a rivet or screw may be used in order to pivotably couple each end of the brace 118 to the respective first and second body portions 22, 24. Each body portion 22, 24 further includes a stop 130 positioned near the aperture 128. The stop 30 operates to support the brace 118 in an upright position and further operates to prevent rearward pivotal movement of the brace 118 when a guitar is supported thereon.

The brace 118 is pivotable relative to the main body 12 between a use position, shown in FIG. 9, and a stowed, or locked, position, shown in FIG. 10. Further, the brace 118 may be removed when the stand 110 is in the second use configuration to support or prop the neck 80 of the guitar 70. Illustratively, therefore, the brace 118 of the stand 10 operates to provide both additional support for the guitar 70 when the guitar 70 is in an upright position and to lock the main body 12 of the stand 10 in the closed position. Further, while the brace 118 operates to lock the main body in the closed position, it is also within the scope of this disclosure to provide another suitable locking mechanism such as a latch coupled to the main body 12 in order to lock the main body 12 in the closed position.

The stand 110 further includes a spring 160 coupled to and positioned between the body portions 22, 24, as shown in FIG. 9. The spring 160 may be attached to the main body 12 via apertures (not shown) through each body portion 22, 24. Illustratively, the spring 160 is a coil spring. However, other suitable springs may be used as well. Further illustratively, the spring 160 operates to bias the bottom end of the body portions 22, 24 away from each other to an opened position. As such, the spring 160 operates to maintain the main body 12 in the opened or use position. While the stand 110 is shown to include the spring 160, it is within the scope of this disclosure to include a stand which does not include any such spring (such as the stand 10 shown in FIGS. 1-8), as well as to include a stand having another device, such as a locking hinge or support bar, for example, which operates to maintain the main body 12 in the opened position.

The stand 110 of FIGS. 9 and 10 further includes a travel limit strap 62 coupled to and positioned between the body portions 22, 24 as shown in FIG. 1. The travel limit strap 162 may be positioned toward the front or rear of the main body 12 and may be made from various materials such as leather, wire, and/or fabrics or textiles, for example. The travel limit strap 162 operates to prevent movement of the bottom end of the body portions 22 in a direction away from each other beyond a predetermined distance (i.e., the length of the strap 162). In other words, the travel limit strap 162 limits the maximum distance that the bottom ends of the body portions 22, 24 may be moved away from each other.

In the closed or stowed position of FIG. 10, the bottom ends of the portions 22, 24 of the stand 110 are positioned adjacent each other, against the bias of the spring 160, such that the front and rear legs 14, 16 and neck rest 20 are positioned between the body portions 22, 24. In the illustrative stand 110, the travel limit strap 162 is flexible and fold to a stowed position between the body portions 22, 24 as well. The brace 118 of the stand 10 is then pivoted relative to the main body 12 to a locked position, as shown in FIG. 10. In the locked position, the main body 12 is positioned between two outer arms 156 of the brace 18 to maintain the main body 12 in the stowed position against the bias of the spring 160.

To move the stand 110 to the first use position, a user simply pivots the brace 118 relative to the main body 12 to the upright, first use position shown in FIG. 9. As noted above, the brace 118 is pivoted until the longitudinal arms 56 of the brace 118 engage the stops 130 coupled to each respective body portion 22, 24. As such, the brace 118 is supported in the upright position. Once the brace 118 is moved from the locked position, the spring 160 operates to bias the bottom end of the body portions 22, 24 away from each other toward the first use position shown in FIG. 9. Similar to the stand 10, once the stand 110 is in the first use position, the body 82 of the guitar 70 may be placed in an upright position within the J-shaped cutout 69 of the front legs 14 such that the back of the guitar body 82 rests on and is further supported by the front surface 18 of each body portion 22, 24 as well as the brace 118. As noted above, the travel limit strap 162 prevents the bottom end of the body portions 22, 24 of the stand 10 from moving farther away from each other as the stand 110 supports the weight of the guitar 70 thereon.

When the stand 110 is to be configured in the second use position to support the neck 80 of the guitar 70, the neck rest 20 is removed from its stowed position and the main body 12 of the stand 110 is moved to the open, or use, position. The ends of the brace 118 are removed from the respective apertures 128 of each body portion 22, 24 to remove the brace 118 from the main body 12 in order to allow the neck 80 of the guitar 70 to be supported by the neck rest 20 in a generally horizontal position thereon.

Illustratively, the stands 10, 110 are shown to support the guitar 70 which is an illustrative electric guitar. As such, the size and shape of the front legs 14 are configured to receive and support the body of a typical electric guitar, such as guitar 70, therein. Because the thickness and shape of guitars may vary, the stands 10, 110 may also be varied to accommodate such different sizes and shapes. In particular, the distance 84 between the rear member 60 and the front member 68, which helps to define the size of the J-shaped cutout 69, of each front leg 14 is sized to generally match the thickness or width of the body of a typical electric guitar. However, it is within the scope of this disclosure to provide a stand having front legs which are sized to support electric and acoustic guitars as well as electric and acoustic bass guitars.

Further, it is within the scope of this disclosure to provide a stand configured to support other musical instruments thereon. For example, the stands 10, 110 of the present disclosure may be configured to support a violin, a viola, a banjo, or other such stringed instruments. Finally, it is within the scope of this disclosure to provide a stand configured to support guitar-shaped controllers or instruments used with various video games. For example, the stands 10, 110 may be configured to support the guitar-shaped controller used with the Guitar Hero® series of music video games or the Rock Band™ series of video games, each of which was developed by Harmonix Music Systems, Inc. (Cambridge, Mass.). As such, the stands 10, 110 of the present disclosure are provided to support various stringed musical instruments and game controllers or instruments shaped to resemble such stringed musical instruments thereon. Accordingly, the term "musical instrument" is intended to encompass various musical instruments such as those described above, for example, as well as video consoles or instruments shaped like a musical instrument.

There are a plurality of advantages of the concepts of the present disclosure arising from the various features of the systems described herein. It will be noted that alternative embodiments of each of the systems of the present disclosure may not include all of the features described yet still benefit from at least some of the advantages of such features. Those of ordinary skill in the art may readily devise their own implementations of a system that incorporate one or more of the features of the present disclosure and fall within the spirit and scope of the invention as defined by the appended claims.

The invention claimed is:

1. A stand for a musical instrument having a body and a neck comprising:

a main body including a first body panel, a second body panel, and a hinge coupled to and positioned between the first and second body panels such that the first and second body panels are configured to pivot relative to one another;

a pair of front legs including a first front leg coupled to the first body panel and a second front leg coupled to the second body panel, wherein the pair of front legs is configured to receive the body of the musical instrument thereon; and a neck rest configured to be removably coupled to the main body, wherein the neck rest is configured to receive the neck of the musical instrument thereon, and wherein one of the first and second body panels includes a pair of apertures and the neck rest includes a pair of pegs configured to be received within the pair of apertures when the neck rest is in a stowed position.

2. The stand of claim 1, wherein the first front leg is pivotably coupled to the first body panel and is movable relative to the first body panel between a stowed position and an extended position, and the second front leg is pivotably coupled to the second body panel and is movable relative to the second body panel between a stowed position and an extended position.

3. The stand of claim 2, wherein each of the first and second front legs includes a hook and each of the first and second body panels includes a respective first and second pin received within the hook of each of the respective first and second front legs when the front legs are each in the extended position.

4. The stand of claim 2, wherein each of the first and second front legs is positioned within the outer perimeter of the respective body panel when in the stowed position.

5. The stand of claim 1, wherein each of the first and second body panels includes a front end wall having respective first and second bores formed therein, the first and second bores being configured to receive the pair of pegs of the neck rest therein when the neck rest is in a use position.

6. The stand of claim 1, further comprising a pair of rear legs including a first rear leg pivotably coupled to the first body panel and a second rear leg pivotably coupled to the second body panel.

7. The stand of claim 6, wherein the first and second rear legs are each movable between a stowed position generally located within the outer perimeter of the respective body panel and an extended position.

8. The stand of claim 1, wherein the neck rest includes a curved member configured to support a neck of a musical instrument thereon.

9. The stand of claim 8, wherein the neck rest further includes a first tab extending downwardly from the curved member, a first peg coupled to the first tab of the neck rest, a second tab extending downwardly from the curved member, and a second peg coupled to the second tab of the neck rest, wherein the neck rest is configured to be positioned in (i) a stowed position wherein the pegs are received within first and second apertures each formed in one of the first and second body panels of the main body, and (ii) a use position wherein the first peg is received within a first bore formed in a front end wall of the first body panel and the second peg is received within a second bore formed in the front end wall of the second body panel.

10. The stand of claim 1, wherein the hinge includes a first plurality of tabs coupled to the first body panel and a second plurality of tabs coupled to the second body panel, and wherein the first and second plurality of tabs are alternatingly positioned between each other such that each tab of the second plurality of tabs is positioned between adjacent tabs of the first plurality of tabs.

11. The stand of claim 10, wherein the hinge further includes a stop mechanism to prevent pivoting movement of the first and second body panel relative to each other beyond a predetermined orientation.

12. A stand for a musical instrument having a body and a neck comprising:

a main body having first and second body panels configured to move between a use position and a stowed position;

a front leg pivotably coupled to one of the first and second body panels and configured to move between a stowed position wherein generally the entire front leg is positioned within the outer perimeter of the respective one of the first and second body panels and an extended position wherein the front leg extends out beyond the outer perimeter of the respective one of the first and second body panels, and further wherein the front leg is configured to support the body of the musical instrument when the front leg is in the use position; and a rear leg pivotably coupled to one of the first and second body panels and configured to move between a stowed position wherein generally the entire rear leg is positioned within the outer perimeter of the respective one of the first and second body panels and an extended position wherein the rear leg extends outwardly beyond the outer perimeter of the respective one of the first and second body panels;

a neck rest configured to be removably coupled to the main body, wherein the neck rest is movable between a stowed position and a use position, and wherein generally the entire neck rest is located within the outer perimeter of each of the first and second body panels of the main body when the neck rest is in the stowed position, and wherein the neck rest is positioned outside the outer perimeter of both of the first and second body panels of the main body when the neck rest is in the use position.

13. The stand of claim 12, wherein the second body panel is pivotably coupled to the first body panel.

14. The stand of claim 13, wherein the main body further includes a hinge having a first plurality of tabs integrally formed with the first body panel and a second plurality of tabs integrally formed with the second body panel.

15. The stand of claim 12, wherein the stand is able to be positioned in a first configuration such that the stand is configured to receive and support the body of the musical instrument thereon and a second configuration such that the stand is configured to receive and support a portion of the neck of the musical instrument thereon.

16. A stand for a musical instrument having a body and a neck comprising:

a main body configured to move between an opened position and a closed position, the main body including a first body panel, a second body panel, and a hinge pivotably coupling the first and second body panels to each other;

a pair of front legs pivotably coupled to the main body, each leg of the pair of front legs being generally J-shaped to define a J-shaped cut-out configured to receive the body of the musical instrument therein;

a pair of rear legs pivotably coupled to the main body; and a neck rest configured to be removably coupled to the main body and including a curved portion configured to support the neck of the musical instrument thereon;

wherein the first and second body panels are spaced apart from each other in the closed position in order to define a storage space between the first and second body panels configured to receive the pair of front legs, the pair of rear legs, and the neck rest therein.

* * * * *